US006962276B2

(12) United States Patent
Fradkin

(10) Patent No.: US 6,962,276 B2
(45) Date of Patent: Nov. 8, 2005

(54) SUIT HANGER WITH ROTATABLE TROUSER BAR

(76) Inventor: Edward Fradkin, 7 Greenbriar La., Perrineville, NJ (US) 08535

( * ) Notice: Subject to any disclaimer, the term of this patent is extended or adjusted under 35 U.S.C. 154(b) by 26 days.

(21) Appl. No.: 10/665,163

(22) Filed: Sep. 22, 2003

(65) Prior Publication Data

US 2005/0061839 A1 Mar. 24, 2005

(51) Int. Cl.[7] ..... A41D 27/22
(52) U.S. Cl. ..... 223/88; 223/95
(58) Field of Search ..... 223/88, 95

(56) References Cited

U.S. PATENT DOCUMENTS 1,867,614 A * 7/1932 Cuscaden ..... 223/88
2,061,704 A * 11/1936 Israelson ..... 223/88
2,185,253 A * 1/1940 Klein ..... 223/88
2,191,401 A * 2/1940 Russell et al. ..... 223/88
2,990,985 A * 7/1961 Begley ..... 223/88
3,412,911 A * 11/1968 Eshelman ..... 223/95

* cited by examiner

*Primary Examiner*—John J. Calvert
*Assistant Examiner*—James G Smith
(74) *Attorney, Agent, or Firm*—Charles I. Brodsky

(57) ABSTRACT

A suit hanger having a first generally horizontally disposed bar extending between edges of the opposing shoulder portions of the hanger includes a second generally horizontally disposed bar coupled with an outwardly rotatable hinge from the first bar to allow the trousers of a suit to be removed from the hanger without having to first remove its jacket.

9 Claims, 1 Drawing Sheet

SUIT HANGER WITH ROTATABLE TROUSER BAR

CROSS-REFERENCE TO RELATED APPLICATIONS

None

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not Applicable

BACKGROUND OF THE INVENTION

1. Field of the Invention

This invention relates to garment supporting devices, in general, and to a suit hanger for supporting a first garment piece having shoulder portions while independently supporting a second garment piece having leg portions, in particular.

2. Description of the Related Art

Suit hangers for use at home, or for trying on suits in a Men's clothing store, have been well described in the prior art.

For example:

a) U.S. Pat. No. 2,113,394 shows pivot connections at an upper portion of a hanger which allows for supporting more than one garment at the same time;

b) U.S. Pat. No. 2,137,268 describes a companion device, modified to receive and hold moth or other insect repellant preparations, in allowing for the support of a series of separate articles of wearing apparel in spaced relationship one-to-another;

c) U.S. Pat. No. 2,822,967 sets out a construction which allows the jacket and trousers of a suit to hang at the same height, so as not to drag on a closet floor or obstruct the view of the bottom space of a closet or wardrobe;

d) U.S. Pat. No. 5,645,200 describes a modification of a hanger design near the neck area, in providing a uniquely shaped bar for the hanging of trousers—a spring and ball arrangement being included to allow the garments to be slightly inclined when mounted as a manner of facilitating their removal and a hanging which limits their being wrinkled when hung; and e) U.S. Pat. No. 5,664,709 shows a hanger whose configuration is particularly useful in supporting garment sets of pants and jackets for men, and also jacket and skirt sets for women.

U.S. Pat. No. 5,038,979 points out one limitation of these types of general construction in that the jacket (or coat) must first be removed in order to remove the trousers from the horizontal bar forming part of the conventional hanger construction. As noted, the jacket (or coat) had to be first removed in order to remove the trousers from the bar, and could not then be replaced until after the trousers had been repositioned. Such arrangement was said to be obviously disadvantageous in that a person dressing normally puts the trousers on before the jacket (or coat) and reverses the sequence when undressing. The invention set out a construction in which the horizontal bar which conventionally extends between the opposing shoulder portion edges of the hanger was removed, and placed instead between a second neck portion integrally joined with the central neck portion of the original conventional hanger itself.

While U.S. Pat. Nos. 2,686,620 and 3,651,999 also show hangers designed to allow separate removal of the trousers from the jacket (or coat), each provides a construction which is different from the conventional hanger arrangement of a central neck portion, opposing shoulder portions extending from each edge of the neck portion to a predetermined point for supporting the jacket (or coat), and a generally horizontally disposed bar rigidly affixed between those predetermined points for supporting the trousers of the suit.

As will be readily appreciated, untold millions of these conventional suit hangers are in present distribution and already in use today—and it would be helpful to provide some easy adjustment to these hangers to permit trousers to be removed without the annoyance of having to first remove the jacket (or coat) from the hanger, as an alternative to having to discard these hangers for any of those modified designs. As will become clear from the description that follows, the suit hanger of the present invention is able to satisfy this objective—in a small, simple design which essentially does not take up any more room than the conventional hangers in use. As will also be seen, very few moving parts need be added, in an overall construction which is both inexpensive to modify, and exceedingly effortless in its operation.

SUMMARY OF THE INVENTION

As will become clear from the following description, a second generally horizontally disposed bar is added to the conventional configuration according to the invention, to be coupled with it and rotatable outwardly from it and at fixed angular stops. As will be described, this second horizontal bar supports the trousers, with the rotation being such that at one fixed angular stop, the second bar lies substantially in the same horizontal plane as the original conventional horizontal bar to begin with, and at a second stop, such second bar lies within a horizontal plane either above or below that of the conventional bar.

As will be described below, in a preferred embodiment of the invention, the second bar is coupled with the first bar by a rotatable hinge having cut-out steps at fixed angular intervals. Such intervals may be at 30° spacing, for example, utilizing a hinge which is spring actuated to lock the second bar into each of the cut-out angular stops. With the two bars and the hanger composed of a wood manufacture, a resilient wire may be included, fixedly secured at one end of the second bar, running along its length towards its opposite end to be temporarily stored there in securing the trousers in place. In accordance with the invention, the first bar and the hanger member to which it is affixed can be of the typical integral manufacture, with the second bar being incorporated with the hinge as a second, separate manufacture to be joined therewith in fixing the trousers in place. In such arrangement, one need only purchase such second manufacture, and merely clip it to the already existing horizontal bar in allowing the separate trouser removal to follow. As will be appreciated by those skilled in the art, such modified construction could likewise follow, in accordance with the invention, incorporating the second bar and the rotatable hinge together with the hanger member and the first bar as a unitary integral manufacture to begin with. In such manner, an owner of an existing, conventional garment hanger need only purchase the clip attachment of the first type description, while new purchases could be made of the unitary hanger design with the clip attachment already in place, as in the second type description.

BRIEF DESCRIPTION OF THE DRAWINGS

These and other features of the invention will be more clearly understood from a consideration of the following description, taken in connection with the accompanying drawings, in which.

DETAILED DESCRIPTION OF THE INVENTION

Figure 1:
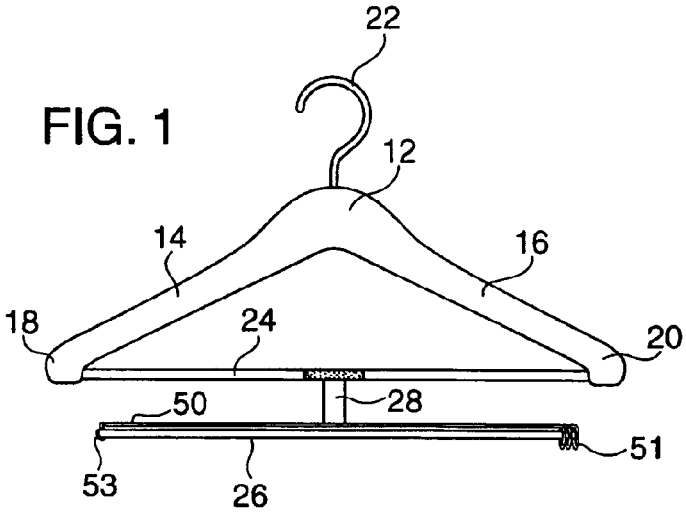
FIG. 1 is an illustration of the garment supporting suit hanger device of the invention ready to receive the jacket (or coat) about its central neck portion and the trousers about the second generally horizontally disposed bar in its described rotative coupling.

Referring to the Drawings, the suit hanger garment supporting device of the invention includes a hanger member 10 having a central neck portion 12 and opposing shoulder portions 14, 16 extending from each end of the neck portion to a predetermined point 18, 20 for supporting a jacket (or coat) first garment piece along the shoulder portions 14, 16. A suspension hook 22 couples the neck portion 12 to engage a support for the hanger member 10, in the nature of a rack, a bar, or other such hanging arrangement. In accordance with conventional suit hanger garment supporting devices, a first generally horizontally disposed bar 24 is included, rigidly affixed between the predetermined points 18, 20 of the opposing shoulder portions 14, 16, and in a first horizontal plane. In accordance with the teachings of the present invention, on the other hand, a second generally horizontally disposed bar 26 is additionally included, coupled with the first bar 24 as by the coupler 28 and rotatable outwardly from the bar 24 at fixed angular stops—the second bar 26 being dimensioned to support the second garment piece trousers, or similar garment having a leg portion to it. As FIGS. 2 and 3 will be understood to illustrate, one of the angular stops places the second bar 26 in substantially the same horizontal plane as the first bar 24, while FIG. 4 illustrates a second angular stop placing the bar 26 in a horizontal plane either above the horizontal plane for the first bar 24, or below it.

Figure 2:
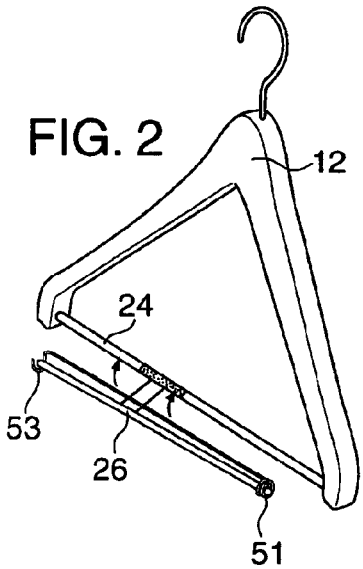
FIGS. 2–4 are illustrations helpful in an understanding of the operation of the garment supporting device of FIG. 1.
Figure 3:
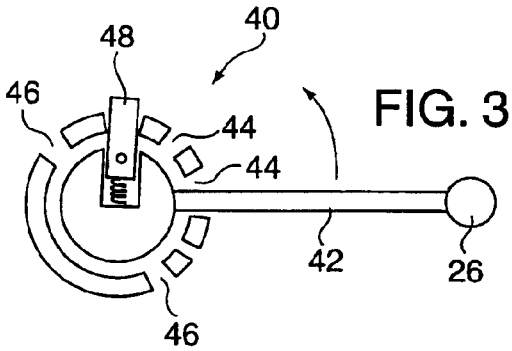
Figure 4:
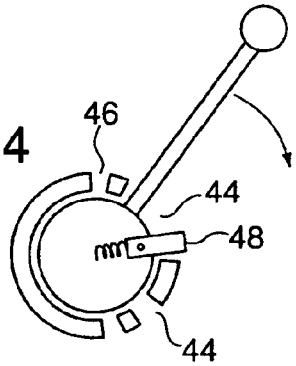

In a preferred embodiment of the invention, the coupler 28 may include a rotatable hinge, generally shown at 40 in FIGS. 3 and 4, with an arm 42 joined with the second horizontal bar 26 shown as an end view. Cut-out stops exemplified at 44 and 46 in FIGS. 3 and 4 are positioned at fixed angular intervals along the periphery of the hinge 40—for example at 30° angular spacings. As will be understood by those skilled in the art, the hinge 40 may be actuated by a spring construction 48 of any appropriate design to lock the second bar 26 within each of the stops as desired. FIG. 3 will be appreciated to represent one arrangement of the invention in particular with the second horizontal bar 26 rotatable counterclockwise to place the second horizontally disposed bar 26 in a plane above that of the first horizontal bar 24; conversely, FIG. 4 represents the arrangement where the second horizontal bar 26 is rotatable clockwise to place the second bar 26 in a horizontal plane below that formed by the horizontal bar 24. As will be understood, any numbers of cut-outs at these or different angular spacings may be utilized for raising or lowering the second bar 26 in placing the bar 26 and its supported trousers outwardly from the jacket (or coat) then being supported about the central neck portion 12 and the opposing shoulder portions 14, 16 on the hanger member 10. A resilient wire 50, for example, is shown in FIG. 2, fixedly secured at one end 51 of the second bar 26 and running along its length towards its opposite end, to act as a temporary securement to any trousers draped on the second bar 26, with the curved portion 53 of the wire 50 dimensioned to receive the bar 26 within its curvature in well known manner.

As the most prevalent construction for the conventional garment support devices as to which this invention represents an improvement is of a wood composition, the second bar 26 of the garment supporting device of the invention may likewise be of a wood manufacture. In implementing the invention to operate with already existent garment support hanger devices in use, the coupler 28 and the second bar 26 may be constructed as a single integrated unit, to be merely clipped over the already existing bar 24. While such "retrofit" operates perfectly well, one may desire to join everything together as an original single manufacture—in which case the hanger member 10, the generally horizontally displaced bars 24 and 26, and the coupler 28 may all be fabricated and sold as a single integrated unit. When constructed as an "add-on" to an existing garment support device, the added modification can be constructed quite easily and inexpensively, and will be seen to provide the desired results in a simplified manner.

The end result of the present invention will thus be seen to be that the horizontal bar of the suit hanger that trousers normally are folded upon is hinged with a second bar which is rotatable to a horizontal position in receiving the trousers when the are to be taken off, with the second bar then being rotatable back up-or-down to snap into place holding the trousers within the resilient clamp on the second bar. When it is desired to put the trousers on, that second bar is just rotated outwardly again, the trousers removed, and without the jacket (or coat) being displaced in any manner. The suit jacket (or coat) then always remains in place, and does not have to be taken off to put the trousers on. As will be appreciated, this has advantages in not only not having to find a place to rest the jacket (or coat) when putting the trousers on first, but is of significant importance in the trying on of suits in a Men's clothing store, where it is not uncommon to see jackets (or coats) draped over racks of clothing while individual pairs of trousers are being individually tried on—where it then becomes necessary to reassemble the suit garments not selected for purchase back onto the hanger with as little "wrinkling" as possible.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the invention.

I claim:

1. A garment supporting device comprising:

a hanger member having a central neck portion and opposing shoulder portions extending from opposite edges of said neck portion to a predetermined point for supporting a first garment piece with shoulder portions;

a suspension hook at said neck portion for engaging a support for said hanger member;

a first bar affixed between said predetermined points on each of said opposing shoulder portions of said hanger member disposed in a first generally horizontal plane; and a second bar coupled with said first bar and rotatable outwardly therefrom at fixed angular stops with respect thereto for supporting a second garment piece with leg portions;

with one of said angular stops placing said second bar in substantially the same generally horizontal plane as said first plane and with another of said angular stops placing said second bar in a generally horizontal plane above or below said first plane.

2. The garment supporting device of claim 1 wherein said second bar is coupled with said first bar by a rotatable hinge.

3. The garment supporting device of claim 1 wherein said second bar is coupled with said first bar by a rotatable hinge having fixed cut-out stops at predetermined angular intervals thereon.

4. The garment supporting device of claim 1 wherein said second bar is coupled with said first bar by a rotatable hinge having fixed cut-out stops at predetermined angular intervals thereon of 30° spacing.

5. The garment supporting device of claim 3 wherein said rotatable hinge is spring actuated to lock said second bar within each of said cut-out stops.

6. The garment supporting device of claim 1 wherein said hanger member and said first and second bars are each of a wood composition.

7. The garment supporting device of claim 1, also including a resilient garment contact member fixedly secured at one end of said second bar and running along said second bar toward an opposite end thereof to be temporarily secured thereat in holding said second garment piece in place.

8. The garment supporting device of claim 2 wherein said first and second bars and said rotatable hinge are incorporated with said hanger member as an integral manufacture.

9. The garment supporting device of claim 2 wherein said first bar is incorporated with said hanger member as a first integral manufacture, and wherein said second bar is incorporated with said hinge as a second, separate integral manufacture in joining therewith to form said garment supporting device.

* * * * *